169-46 SR
11/23/76 OR 3,993,137

United States Patent [19]
Hefetz

[11] 3,993,137
[45] Nov. 23, 1976

[54] METHOD AND DEVICE FOR EXTINGUISHING FIRES IN OIL WELLS

[76] Inventor: Uriel Hefetz, P.O. Box 6037, Jerusalem, Israel

[22] Filed: May 27, 1975

[21] Appl. No.: 581,147

[30] Foreign Application Priority Data

May 31, 1974 Israel ..... 44935

[52] U.S. Cl. ..... 169/46; 166/55; 166/297; 169/69

[51] Int. Cl.[2] ..... A62C 1/22

[58] Field of Search ..... 169/69, 46; 166/55, 166/75, 81, 92, 93, 241, 297

[56] References Cited

UNITED STATES PATENTS

| | | | |
|---|---|---|---|
| 1,949,672 | 3/1934 | Barrier | 166/93 X |
| 2,840,166 | 6/1958 | Eckel et al. | 166/55 |
| 3,732,924 | 5/1973 | Chelette et al. | 166/55 |
| 3,833,020 | 9/1974 | Smith | 166/55 X |
| 3,867,964 | 2/1975 | Gardner | 166/55 X |
| 3,884,298 | 5/1975 | Watkins | 166/75 X |

*Primary Examiner*—Evon C. Blunk
*Assistant Examiner*—Michael Mar
*Attorney, Agent, or Firm*—Price, Heneveld, Huizenga & Cooper

[57] ABSTRACT

Method and apparatus for extinguishing fires in oil wells. The method includes the steps of: attaching a shell which is integral with required guides and valves to the outer oil producing pipe or its casing; inserting at least one positioning pin member through the outer pipe at a first level to immobilize the inner pipe relative to the outer pipe; and driving at least one drill at a second lower level through both pipes into a closed plug housing diametrically opposed thereto, so that part of the wall of the outer pipe remains in two diametrically opposed positions. The apparatus for carrying out this method includes an arcuate shell of at least two parts having an internal radius equal to the external radius of the outer oil producing pipe and adapted to be attached to the outer wall of the outer pipe; at least one housing containing a positioning pin attached to the shell at one level; and at least one drill guide together with a drill attached to the shell at a level below the first level.

15 Claims, 12 Drawing Figures

METHOD AND DEVICE FOR EXTINGUISHING FIRES IN OIL WELLS

The present invention concerns a method for extinguishing fires in oil wells either underwater or above the ground, and a device for carrying out the method. In particular, the invention concerns an improvement of my prior U.S. Patent Application Ser. No. 546,128, filed Jan. 31, 1975.

The invention consists in a method of extinguishing fires in oil wells comprising the steps of:

a. attaching a shell which is integral with required drill guides and valves to the outer oil producing pipe or its casing;
b. inserting at least one drill pin from said shell through the said outer pipe and at at least one level to immobolize the inner oil producing pipe (tubing) relative to the said outer one;
c. driving at least one drill below said level and drilling through both pipes into a closed guide diametrically opposed thereto, so that part of the wall of said outer pipe remains in two diametrically opposed positions.

The invention further consists in a device for carrying out the abovementioned method, comprising an arcuate shell of at least two parts of an internal radius equal to the external radius of the outer oil producing pipe or its casing and adapted to be attached to said outer wall or its casing, at least one drill housing with a drill attached to the shell at one level and at least one drill guide together with a drill attached to said shell at a level below said first level.

The invention is illustrated in the accompanying drawings, by way of example only, in which.

As well known in oil wells, the position of the inner oil producing pipe 1 (tubing) relative to the outer oil producing pipe 2 cannot be determined from the outside. In the case of fires the slips on which the top of the tubing is mounted may be destroyed so that the tubing may buckle and assume different position relative to the outer pipe at different levels.

Figure 3:
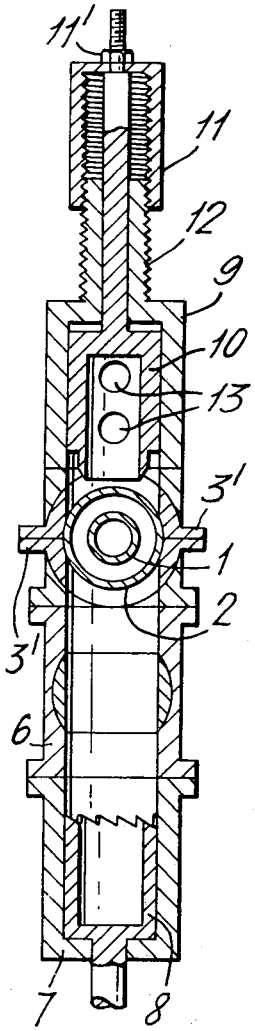

It is the first object of the method according to the invention to immobilize the tubing no matter what its position is relative to the outer pipe 2. To this end a shell 3 which is constituted by two shell halves or more than two sections, if desired, is attached to the outer pipe 2 either by welding or by clamping. Alternatively, as can be seen most clearly from FIG. 3, the two shell halves are provided with integral flanges 3′ through which bolts (not shown) extend to clamp the shells to each other and to the outer wall 2, suitable sealing means being provided between the outer pipe and the edges of the shell parts.

These shells are made integral with four drill guides 4 which are externally threaded in order to effect the advance movement of the pin-like drill 5, by an internally threaded cap 4′ (FIG. 4) through which the end of the pins extend, said ends being shaped so that they can be rotated by a key wrench. Alternatively, any conventional drilling means may be used. The pins 5 are drilled through the outer wall 2, their points being driven into part of the wall of tubing 1, so that the latter is firmly supported by the pins 5.

Figures 1, 2, 4, 5:
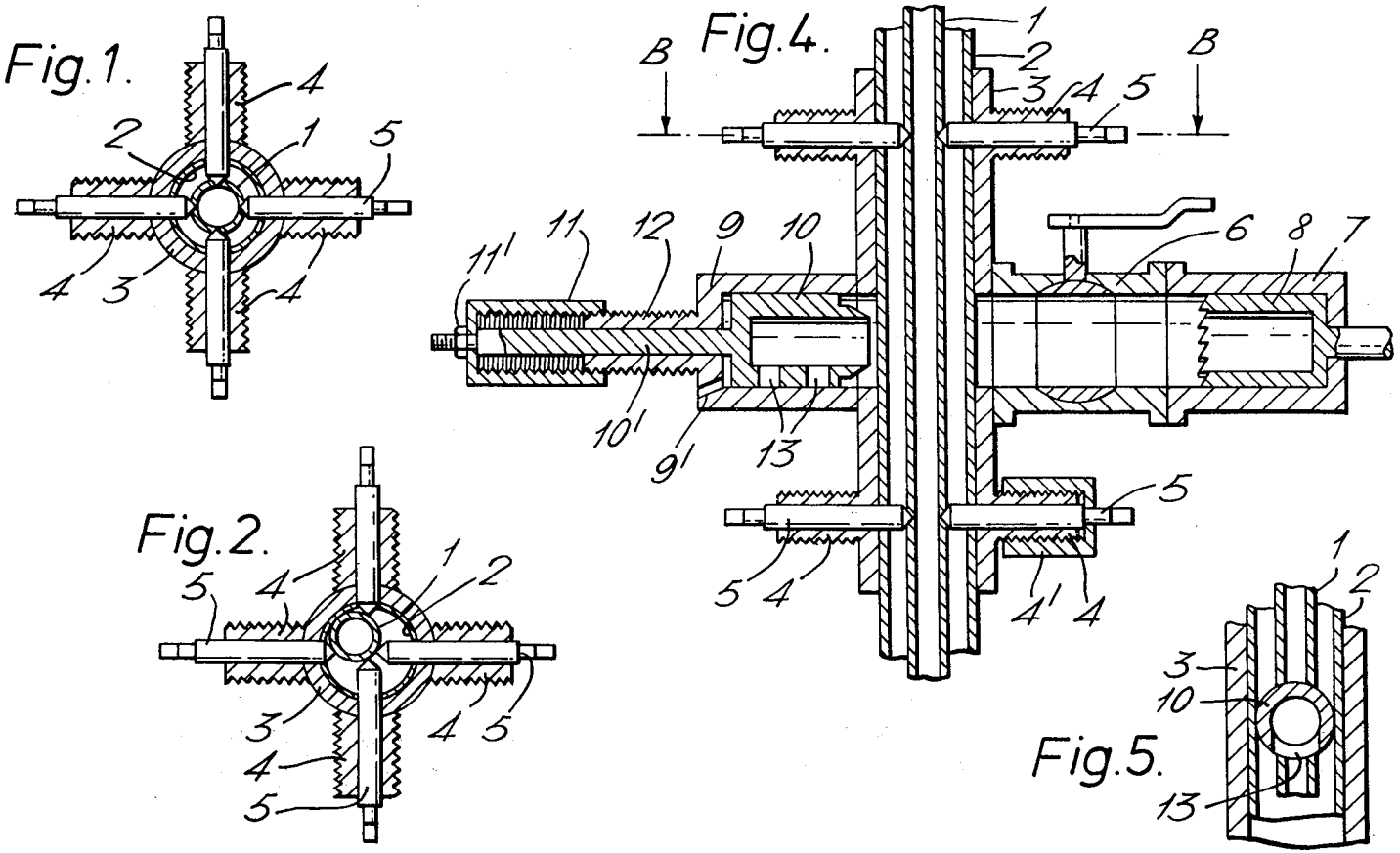
FIG. 1 shows a cross section of one embodiment of the positioning of the inner oil producing pipe (tubing) relative to the outer oil producing pipe, as obtained by the first and second steps of the method according to the invention.
FIG. 2 shows a second embodiment thereof.
FIGS. 3 & 4 show schematically a transverse and vertical cross section, respectively, of one embodiment of the device according to the invention applied to an oil well.
FIG. 5 shows a partial vertical section of a detail.

As can be seen from FIG. 1 the tubing 1 is centrally located relative to the outer pipe 2, while in the case shown in FIG. 2 the tubing 1 is off-center.

It is possible to use only one drill 5 to immobilize tubing 1 relative pipe 2. In this case, the diameter of drill 5 must be slightly larger than the difference between the outer diameter of tubing 1 and the inner diameter of pipe 2 so that the drill 5 can push tubing 1 against pipe 2 and by eating into the wall of tubing 1, firmly hold the latter in place. Alternatively, any suitable number of drills 5 may be used. However, it is preferable to use sets of four drills as has been described hereinabove.

In FIG. 4 two sets of drills 5 are provided at different levels and hold tubing 1 firmly between them and immovable relative to pipe 2. At a level approximately half way between the two sets of pins 5 the shell 3 is made integral with a valve schematically illustrated by 6 which in turn is attached to a drill guide 7 from which a drill 8 can be rotated inwardly through valve 6 and through pipes 2 and 1. At a position on shell 3 which is diametrically opposite to that of valve 6 and is aligned with it, a cylindrical plug housing 9 is made integral with shell 3, the plug housing 9 and valve 6 and drill guide 7 being exactly aligned on one axis. A plug 10 is axially movable within housing 9 by means of an internally threaded cap 11 which can be threaded unto an externally threaded extention 12 on housing 9, the shaft 10′ of plug 10 extending through cap 11 for this purpose. If desired, the plug 10 can be moved hydraulically or pneumatically by attaching suitable means to an opening indicated by dotted lines 9′ in housing 9 of FIG. 4.

The device works as follows: after tubing 1 has been properly positioned by means of drills 5, as has been described hereinabove, and with valve 6 in the open condition, drill 8 is operated to bore through pipes 2 and 1 whereby tubing 1 is severed and only part of the walls of pipe 2, i.e. the parts which lie parallel to the axis of the drill remain. Drill 8 is then withdrawn while valve 6 is closed. Now plug 10 is inserted through the bore in pipe 2 which had been made by the drill 8. It is preferable to push the drill 8 outwards by forcing the plug 10 inwards. It is possible to provide a valve below plug 10 on or below shell 3 to make the well produce until it is completely repaired and proper production can be re-established.

However, according to this embodiment of the invention plug 10 is made hollow and is provided with two outlets 13 which are adapted to be in register with tubing 1 and the annular space within pipe 2 around tubing 1, so that when plug 10 has been driven to close said pipes, communication is established between said pipes and the interior of the plug and valve 6 which can now be opened so that oil may flow through it to make the well produce.

As generally known, after a burning well has been extinguished, and the oil flow is controlled, the well has to be killed usually to allow it to be rebuilt. According to the invention, this is not necessary, because the means are provided by the valve and plug above described to continuously produce from both pipes simultaneously while repairs are made to the installation. If it is desired to separate the production from the two pipes, it will be necessary to kill the well, for a short period only, so that the pipes can be connected to the known producing equipment.

Figure 6:
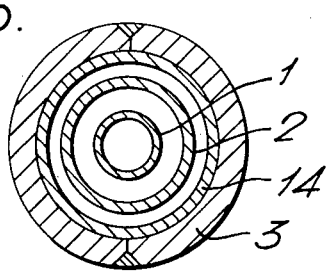
FIG. 6 shows a cross section of the shell attached to a well casing.
Figure 7:
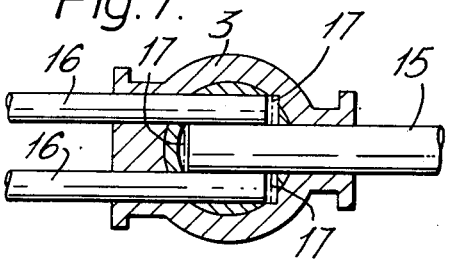
FIG. 7 shows a cross section of a well closed by three plugs.
Figure 9:
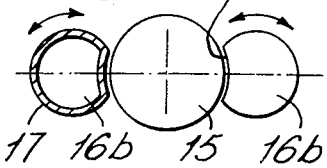
FIGS. 9 & 10 illustrate schematically the position of three plugs in two different embodiments.
Figure 11:
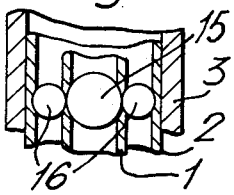
FIGS. 11 & 12 show schematically partial vertical cross sections of the different positions of the two pipes after drilling for three plugs has been effected.
Figure 10:
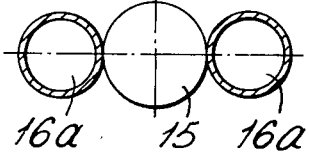
Figure 12:
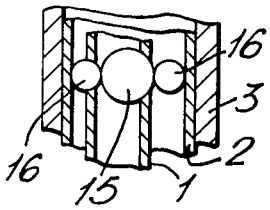
Figure 8:
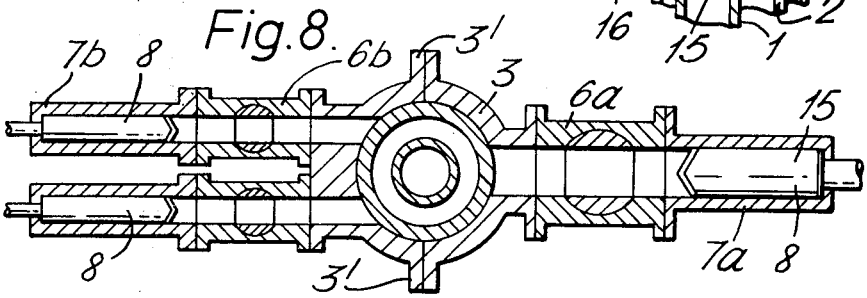
FIG. 8 is a transverse section of a second embodiment of the invention.

FIG. 6 illustrates the attachment by welding of shell 3 to the casing 14 which is provided around pipe 2, as known per se, the weld at the top and bottom of the shell not being visible herein.

It must be understood, that the sets of drill 5, besides immobilizing and holding the tubing 1 relative pipe 2, also serve to prevent a tearing apart of the two parts of the casing 14 or pipe 2, in the case where any drilling operation tends to weaken the walls of the casing or the pipe 2 enough to cause the pressures within them to tear them apart.

The embodiment of the invention illustrated in FIGS. 7–12 differs from that previously described in that three plugs are provided to close the pipes, i.e. three bores must be drilled therefor. The central plug 15 is coaxial with the diameter of the pipes while two co-planar parallel plugs 16 extend on either side thereof, the valves 6*a* and 6*b* and the drill guides 7*a* and 7*b*, respectively, being of similar construction as those described hereinabove with reference to FIGS. 3 and 4. The position of the bores for plugs 15 and 16 can be seen in FIG. 11 in the case where tubing 1 is centrally located relative to pipe 2 and in FIG. 12 in the case where tubing 1 is excentrally located relative to pipe 2.

The plugs may be covered with a resilient coating 17, also at their ends. Plug 16*a* may abut plug 15 or if desired the plug 16*b* may have cut-outs at 18 on the sides which lie adjacent to plug 15. A small rotation of plugs 16*b* in either direction will close the gap between them and plug 15 to tightly cover the pipes. In this case, the plugs 16 must be slightly larger, so that they together with plug 15 extend to the walls of pipe 2.

If desired, it is possible to provide two, or more than three plugs which will cover the cross-sectional areas of both pipes.

It is, of course, understood that the attachment of the shells to the casing or outer pipe must be effected in a fluid tight manner which must be tested by suitable pressure gauges before drilling can begin. All the drills must be sealed against leakage during the drilling and withdrawing operations.

I claim:

1. A method of extinguishing fires in oil wells having an inner pipe and and outer pipe separated by an annular space comprising the steps of:

a. providing a shell member having at least one housing formed thereon at a first level, and drill guide means and a plug housing formed thereon at a second level said plug housing having a plug member mounted therein, said drill guide means and said plug housing being diametrically oppositely positioned;

b. attaching said shell member to the outer pipe;

c. inserting at least one positioning pin member through said housing through said outer pipe and into abutment with said inner pipe at said first level to immobilize said inner pipe relative to said outer pipe;

d. positioning a drill in said drill guide means and drilling through said inner and outer pipes from said drill guide means and into said plug housing;

e. removing said drill from said inner and outer pipes; and f. urging said plug member through said inner and outer pipes to close said pipes.

2. The method of claim 1 wherein said shell is attached by welding to said outer pipe.

3. The method of claim 1 wherein said shell includes at least a pair of arcuate members each having integral flanges formed thereon and wherein said attaching step comprises clamping said members to each other and to said outer pipe.

4. The method of claim 1, wherein said shell member is provided with a plurality of said housings and wherein said inserting step includes inserting a plurality of positioning pins through said outer pipe to immobilize said inner pipe.

5. The method of claim 1, and further including the steps of providing valve means in said drill guide means; extending said drill through said valve means in open position while drilling through said inner and outer pipes; closing said valve means after the step of removing said drill from said inner and outer pipes; and wherein the step of urging said plug member to close said pipes urges said drill through said valve means.

6. The method of claim 5, and further including the step of providing said plug member with an opening at its inner end and closed at its outer end, and two outlets being provided transverse to said opening adapted to be in register with said inner and outer pipes below said plug, so that when said valve is opened, oil can flow and the well can produce.

7. The method of claim 1, wherein said shell member is provided with a plurality of said guide means each said guide means having valve means formed therein and plug members positioned therein and wherein three drills are led through three corresponding valves attached between the corresponding drill guides and the shell, the central drill being operated from one side, and two parallel drills being operated from diametrically opposite positions in the same plane on either side of said central drill, said plug members being inserted into the three drilled bores, a valve provided below said plugs being opened, after communication between it and the interior of the pipes has been effected, to re-establish production of the well.

8. Apparatus for extinguishing fires in oil wells having an inner pipe and an outer pipe separated by an annular space comprising; an arcuate shell member having an internal radius equal to the external radius of said outer pipe and adapted to be attached to the outer wall of said outer pipe; at least one housing attached to said shell at a first level; at least one positioning member in said drill housing adapted to extend through said outer pipe and into engagement with said inner pipe to hold said inner pipe with respect to said outer pipe; drill guide means attached to said shell at a second level; drill means in said drill guide means adapted to extend through said inner pipe and said outer pipe; plug housing means on said shell member, said plug housing means having at least one plug member movably mounted therein in diametrically opposed position to said drill guide means; said plug member being adapted for movement through said outer and said inner pipes to close said pipes.

9. A device as claimed in claim 8, wherein said drill guide means includes three drill guide members attached to said shell at said second level; said drill guide means each including a plug member, said plug members being movable through said outer and said inner pipe and into abutting relationship to cooperatively close said pipes.

10. A device as claimed in claim 9, wherein said plug members are covered with a resilient coating.

11. A device as claimed in claim 8, wherein said shell is made of at least two parts adapted to be welded to said outer wall of said outer pipe.

12. A device as claimed in claim 8, wherein said shell is made of at least two arcuate parts provided with flanges adapted to receive fastening means to thereby connect the two arcuate parts.

13. The apparatus of claim 8 and further including second housing means having positioning members positioned therein adapted to extend through said outer pipe and into engagement with said inner pipe, said second housing means being positioned at a level below said first level for positioning and holding said inner pipe with respect to said outer pipe.

14. The apparatus of claim 8 and further including valve means in said drill guide means, said valve means being adapted to allow passage of said drill means; said plug means having an opening formed therein, said opening being positionable in communicating relationship with said inner and said outer pipes and said valve means when said drill means is removed from said pipes.

15. The apparatus of claim 14 and further including second housing means having positioning members positioned therein adapted to extend through said outer pipe and into engagement with said inner pipe, said second housing means being positioned at a level below said first level for positioning and holding said inner pipe with respect to said outer pipe.

* * * * *